US008789502B2

(12) United States Patent
Barnes

(10) Patent No.: US 8,789,502 B2
(45) Date of Patent: Jul. 29, 2014

(54) VARIABLE VALVE ACTUATION SYSTEM AND METHOD USING VARIABLE OSCILLATING CAM

(75) Inventor: David M. Barnes, Columbus, IN (US)

(73) Assignee: Cummins Intellectual Property, Inc., Minneapolis, MN (US)

( * ) Notice: Subject to any disclaimer, the term of this patent is extended or adjusted under 35 U.S.C. 154(b) by 128 days.

(21) Appl. No.: 13/398,753

(22) Filed: Feb. 16, 2012

(65) Prior Publication Data

US 2012/0210964 A1 Aug. 23, 2012

Related U.S. Application Data

(60) Provisional application No. 61/443,331, filed on Feb. 16, 2011.

(51) Int. Cl.
*F01L 1/34* (2006.01)

(52) U.S. Cl.
USPC ..... 123/90.16; 123/90.39

(58) Field of Classification Search
USPC ..... 123/90.16, 90.39; 74/569
See application file for complete search history.

(56) References Cited

U.S. PATENT DOCUMENTS

| | | | |
|---|---|---|---|
| 5,611,317 | A | 3/1997 | Peters et al. |
| 5,666,913 | A | 9/1997 | Gustafson et al. |
| 6,615,775 | B2 | 9/2003 | Takemura et al. |
| 7,032,550 | B2 | 4/2006 | Ohtsuka et al. |
| 2005/0066921 | A1 | 3/2005 | Daigo et al. |
| 2007/0240653 | A1 | 10/2007 | Petridis |
| 2008/0141960 | A1 | 6/2008 | Rohe et al. |
| 2009/0038567 | A1 | 2/2009 | Tateno et al. |
| 2009/0266321 | A1 | 10/2009 | Tashiro |
| 2009/0293824 | A1 | 12/2009 | Hwang |

OTHER PUBLICATIONS

The International Search Report and the Written Opinion of the International Searching Authority dated May 25, 2012; International Application No. PCT/US12/25520.

*Primary Examiner* — Zelalem Eshete
(74) *Attorney, Agent, or Firm* — Faegre Baker Daniels LLP

(57) ABSTRACT

A high-efficiency mechanism for variable valve actuation with increased engine architecture applicability is described. The high efficiency mechanism introduces an intermediate lever having a secondary cam profile forming a variable oscillating cam between a rotating camshaft and a rocker arm.

21 Claims, 13 Drawing Sheets

| FUNCTION | SCHEMATIC |
|---|---|
| Variable Overlap | 80a 80b |
| EEVO | 82a |
| LIVC (Miller Cycle) | 84b |
| I-EGR (2nd Bump) | 86b |
| Cylinder Deac. | 88a 88b |
| Variable Swirl | 90a 90b |
| EEVC | 92b |
| EIVC (Variable Lift) | 94b |
| Comp. Braking | 96a |

FIG.10

| FUNCTION | SCHEMATIC |
|---|---|
| Variable Overlap | |
| EEVO | |
| LIVC (Miller Cycle) | |
| I-EGR (2nd Bump) | 104a |
| Cylinder Deac. | |
| Variable Swirl | |
| EEVC | |
| EIVC (Variable Lift) | |
| Comp. Braking | |

FIG.11

VARIABLE VALVE ACTUATION SYSTEM AND METHOD USING VARIABLE OSCILLATING CAM

CROSS-REFERENCE TO RELATED APPLICATIONS

This application claims the benefit of priority to U.S. Provisional Patent Application No. 61/443,331, filed on Feb. 16, 2011, which is hereby incorporated by reference in its entirety.

TECHNICAL FIELD

This disclosure relates to variable valve actuation systems and methods, and, in particular, to variable valve actuation systems and methods using a variable oscillating cam to control actuation of the valve.

BACKGROUND

More stringent fuel economy and emissions standards are driving a need for improving the efficiency of both engines and exhaust aftertreatment (AT) systems. One technology that addresses efficiency in engines and AT system is variable valve actuation (VVA). A VVA system can improve AT thermal management, thereby increasing the AT system's efficiency over a duty cycle. A VVA system can also manage pumping losses through turbo/engine work split management (Miller Cycle) or through cylinder deactivation.

Current state-of-the-art VVA systems can be bucketed into two major categories: mechanical and hydraulic. Hydraulic systems have inherently lower efficiency because they sacrifice some/all valve spring energy recovery to achieve VVA functionality. This hydraulic inefficiency increases the engine's brake specific fuel consumption (BSFC) by an estimated 1-3% over a conventional drive cycle. Current mechanical VVA systems have inherently higher efficiencies but also have limited and/or conjoined functionality and limited engine architecture capability; i.e., these systems require overhead cam(s). An improved VVA system would retain the efficiency benefits of a mechanical system but would increase flexibility of use for an array of engine architectures.

SUMMARY

This disclosure provides an internal combustion engine, comprising a camshaft, a control shaft, a valve, and a valve actuation system. The camshaft includes a first cam. The control shaft includes a second cam. The valve actuation system is adapted to be driven by the first cam and the second cam. The valve actuation system includes an intermediate arm, a first rocker arm, and a control arm. The intermediate arm is adapted to oscillate by the action of the first cam about a first pin. The intermediate arm includes a third cam formed on an end thereof and a first roller located on a second pin. The first rocker is rotatably positioned on the control shaft and includes a foot at a first end and a second roller at a second end opposite the first end. The foot causes movement of the valve by the action of the first cam. The second roller is adapted to rotate about a third pin and is adapted to engage the third cam. The control arm is adapted to rotate about the first pin and includes a third roller in contact with the second cam such that the profile of the second cam causes the control arm to pivot about the third pin, forcing the intermediate arm to move, moving the third cam with respect to the second roller, thereby causing the first rocker arm to rotate about the control shaft and to change the amount the valve moves.

This disclosure also provides an internal combustion engine comprising a camshaft, a control shaft, a valve, a first rocker arm, and an intermediate arm positioned between the camshaft and the first rocker arm. The first rocker arm is adapted to be moved by the camshaft to open the valve. The intermediate arm is movable by the action of the control shaft to change the amount the first rocker arm opens the valve.

Advantages and features of the embodiments of this disclosure will become more apparent from the following detailed description of exemplary embodiments when viewed in conjunction with the accompanying drawings.

BRIEF DESCRIPTION OF THE DRAWINGS

FIG. 10 shows graphs of various functions achievable with a first hardware configuration of the present disclosure.

FIG. 11 shows graphs of various functions achievable with a second hardware configuration of the present disclosure.

DETAILED DESCRIPTION

The present disclosure enables a wide range of variable valve actuation regimes for engine and aftertreatment performance optimization through a high efficiency mechanism with increased engine architecture applicability. The high efficiency mechanism introduces an intermediate lever or arm having a secondary cam profile forming a variable oscillating cam between a rotating camshaft and a rocker arm. The intermediate lever is constrained to an oscillating motion by its pivot, rotating cam contact, and a spring. The intermediate lever's pivot position is variable to change the conventional rocker arm's following of the intermediate lever's cam profile. This variable oscillating cam (VOC) mechanism, in conjunction with cam phasers, can enable early and/or late intake valve closing, early and/or late exhaust valve closing, and variable lift or duration secondary valve events for internal exhaust gas recirculation and compression braking. The system could also be configured to enable variable valve timing, variable valve lift, and variable swirl through independent variable lift of the intake valves. The mechanisms described in this disclosure may require a hydraulic deactivation system to enable cylinder deactivation.

This disclosure includes a multi-function, bi-directional rotatable VOC pivot control shaft integrated with the conventional rocker arm's pivot shaft and a system of rocker arm appendages that enable conjoined and independent rocker motion. Additionally, the systems and methods may include applying VOC to phased and un-phased, primary and secondary, intake and exhaust, lift events for multiple VVA functions.

Figure 1:
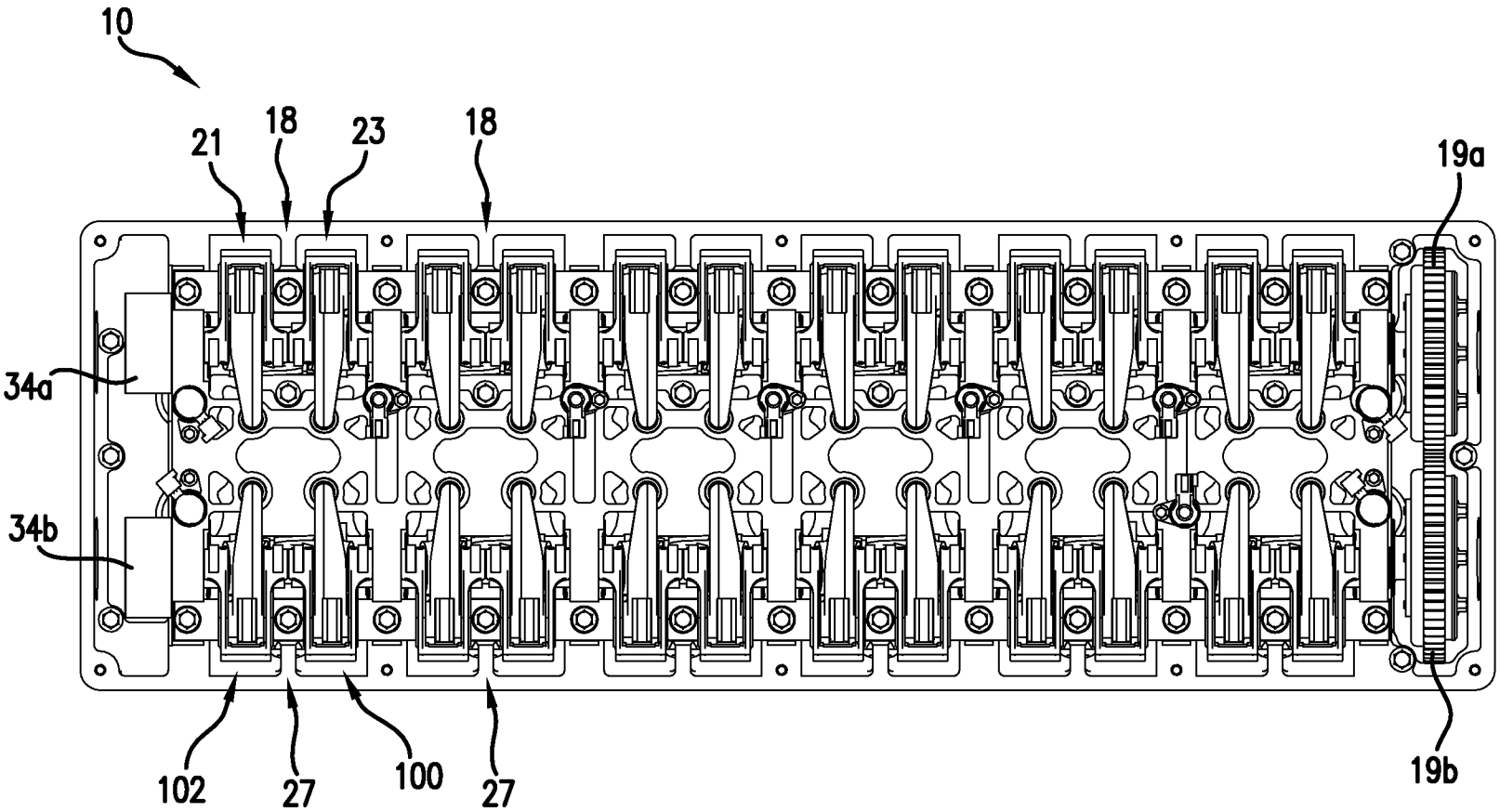
FIG. 1 is a plan view of an internal combustion engine incorporating an exemplary embodiment of the present disclosure, with the engine's top cover removed.
Figure 2:
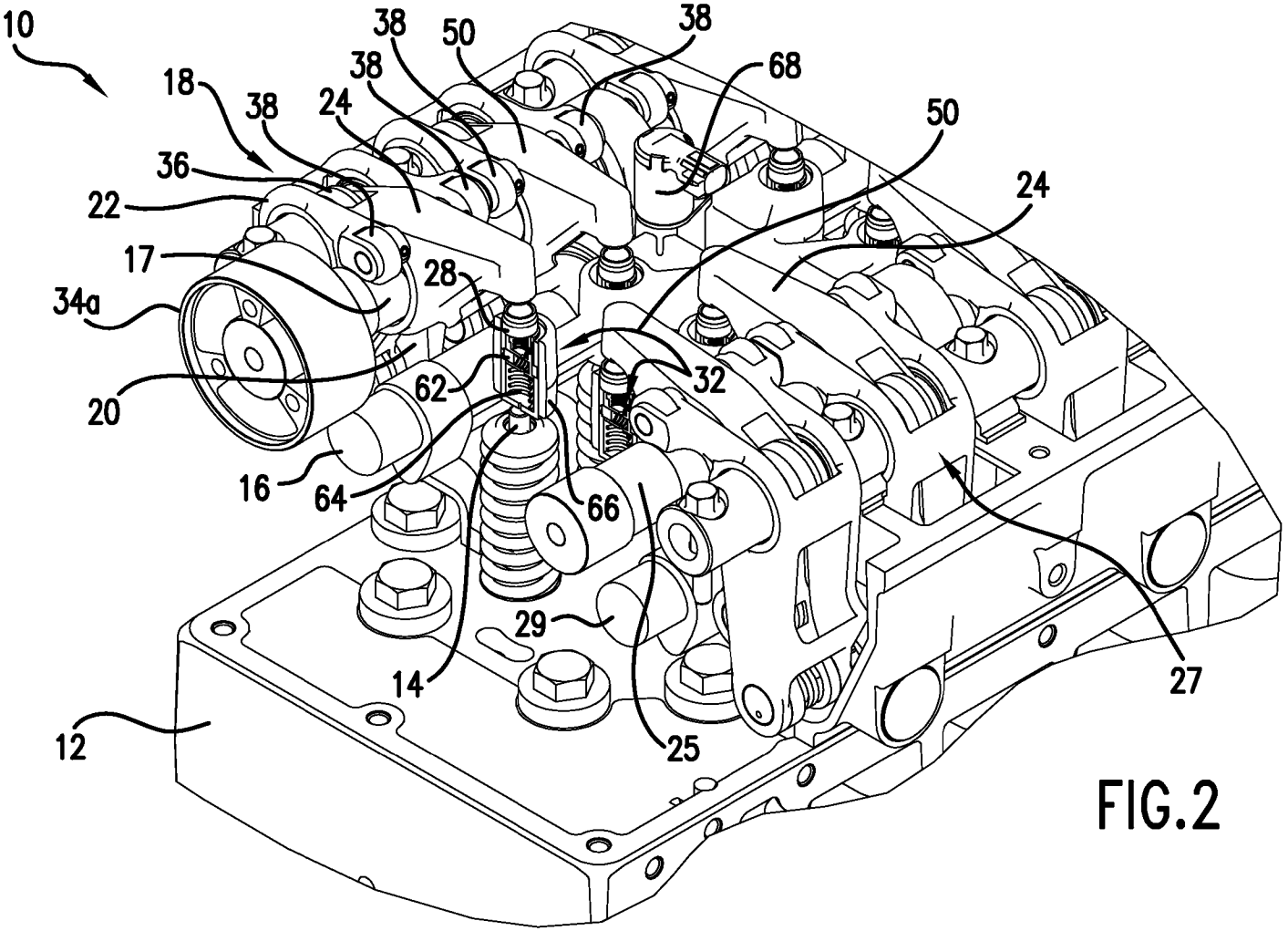
FIG. 2 is a first perspective view of a portion of the internal combustion engine of FIG. 1.
Figure 3:
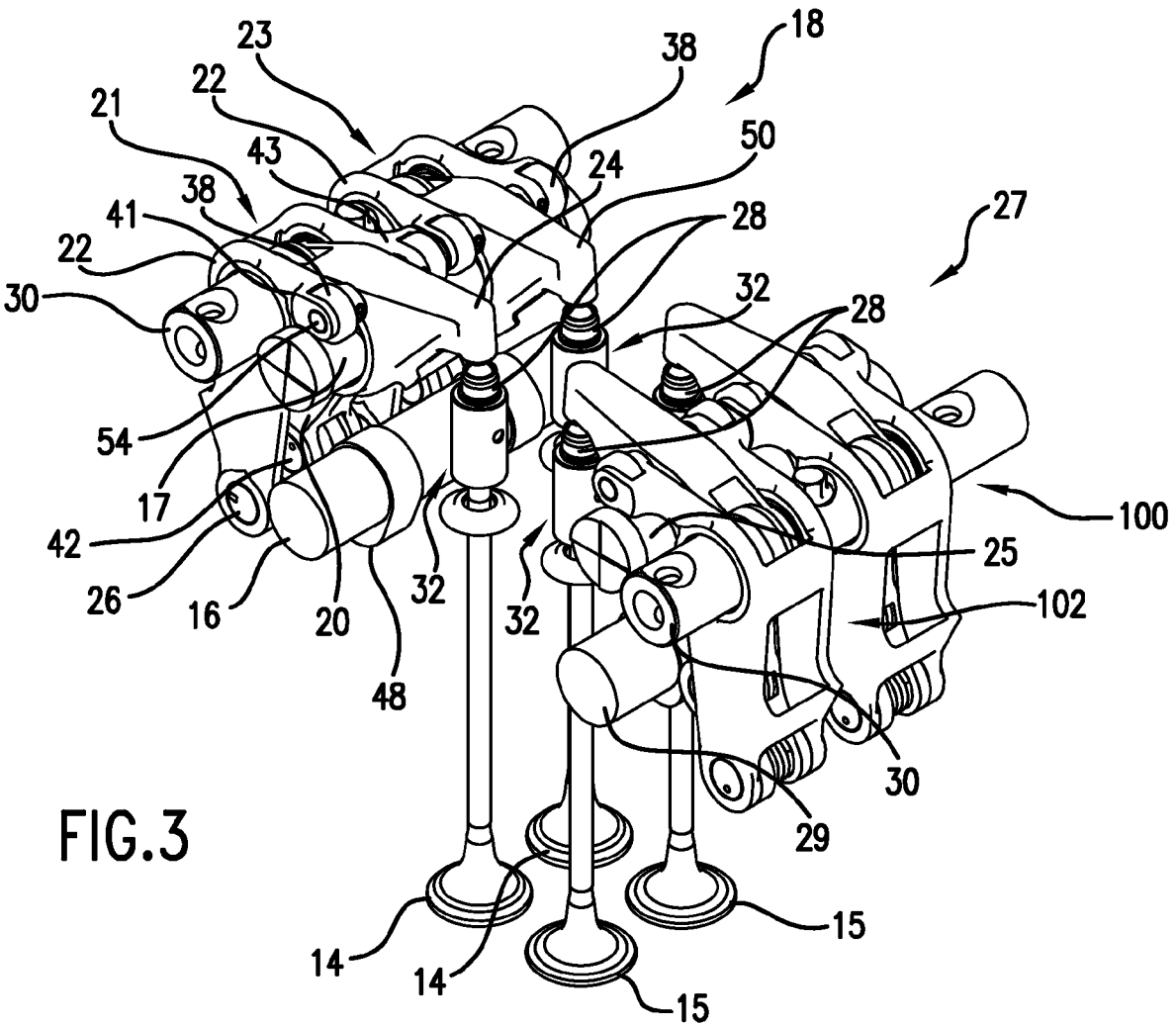
FIG. 3 is a second perspective view of a portion of the internal combustion engine of FIG. 1.

FIG. 1 shows a plan view of an internal combustion engine 10 with a top cover removed. A portion of internal combustion engine 10 is shown in FIGS. 2 and 3. Engine 10 includes an engine cylinder head 12, which is part of an engine body or engine block, a plurality of exhaust valves 14, a plurality of intake valves 15, an exhaust camshaft 16, an intake camshaft 29, an exhaust control shaft 17, an intake control shaft 25, a plurality of exhaust valve actuation systems 18, and a plurality of intake valve actuation systems 27. A plurality of conventional camshaft phasers 19 may also be included in engine 10. Phasers 19 are driven by an engine crankshaft, not shown, in a known manner. Phaser 19*a* drives exhaust camshaft 16 and phaser 19*b* drives intake camshaft 29.

Exhaust control shaft 17 is rotatably supported in engine 10. Exhaust control shaft 17 extends through the plurality of exhaust valve actuation systems 18. As will be seen, exhaust control shaft 17 is operable to modify the effect of exhaust camshaft 16 on exhaust valve actuation system 18. A control shaft phaser 34*a* is connected to an end of exhaust control shaft 17 and is operable to cause rotation of exhaust control shaft 17. Similarly, intake control shaft 25 is rotatably supported in engine 10 and extends through the plurality of intake valve actuation systems 27. Intake control shaft 25 is operable by the action of a control shaft phaser 34*b* to modify the effect of intake camshaft 29 on intake valve actuation system 27.

FIGS. 3-8 show exhaust valve actuation system 18 and intake valve actuation system 27 in more detail. Valve actuation system 18 includes a first portion 21 and a second portion 23. First portion 21 includes a first intermediate lever or arm 20, at least one control lever 22, a first rocker arm 24, a pin 26, a tappet assembly 32*a*, and a torsion spring 56. Exhaust control shaft 17 extends through a bore formed in first rocker arm 24 and supports first rocker arm 24 in engine 10. First rocker arm 24 includes an e-foot 28, a pin 30 positioned in a bore on an opposite side of exhaust control shaft 17 from e-foot 28, and a roller 36. Bearings (not shown) may be positioned within first rocker arm 24 between first rocker arm 24 and exhaust control shaft 17 and between first rocker arm 24 and pin 30. Roller 36 is rotatably positioned on pin 30. Roller 36 contacts a cam profile 46 formed on an end portion of first intermediate lever 20.

First intermediate lever 20 includes a roller 40 and may include a pin 42. Pin 26 extends from control lever 22 on one side of first intermediate lever 20, through intermediate lever 20, and back into control lever 22 positioned on a second side of first intermediate lever 20. Pin 26 may be pressed into control lever 22 or first intermediate lever 20, or rotatably positioned within both control lever 22 and first intermediate lever 20 and constrained through various techniques, for example, retaining rings, to remain positioned within control lever 22 and first intermediate lever 20. Regardless of the mounting technique, pin 26 is configured to permit rotation between control lever 22 and first intermediate lever 20. Note that control lever 22 is shown as a single piece. Alternatively, control lever 22 may be two separate pieces that are held in place by mating with pin 26, by attachment to each other, or by other techniques. Torsion spring 56 may be positioned on pin 26 and configured to provide tension to intermediate lever 20 and to control lever 22 to bias intermediate lever 20 toward camshaft 16. Alternatively, a compression spring positioned between engine 10 and intermediate lever 20 may bias intermediate lever 20 toward camshaft 16. Roller 40 is rotatably connected to first intermediate lever 20 by way of pin 42. Roller 40 engages a cam profile 48 formed on camshaft 16.

Control lever 22 includes a first extension 41 and a second extension 43. Each extension includes a roller 38 and a pin 54. Each roller 38 attaches to a respective extension by way of pin 54. Pin 54 is configured to permit roller 38 to rotate freely with respect to a respective extension of control lever 22. Alternatively, roller 38 may be a roller bearing and fixedly attached to pin 54, which may then be fixedly attached to a respective extension of control lever 22. Each roller 38 contacts a cam profile 44 formed on control shaft 19. Control lever 22 may be rotatably positioned on pin 30 that extends from control lever 22 through roller 36, then through first rocker arm 24 and back into control lever 22. Alternatively, pin 30 may be fixed to control lever 22 and rotatably positioned within first rocker arm 24. In another configuration, pin 30 may rotate within both first rocker arm 24 and each extension of control lever 22 and constrained within both first rocker arm 24 and control lever 22 by a variety of techniques. For example, pin 30 could be held in position by retaining rings (not shown) located in control lever 22 and first rocker arm 24.

Figure 4:
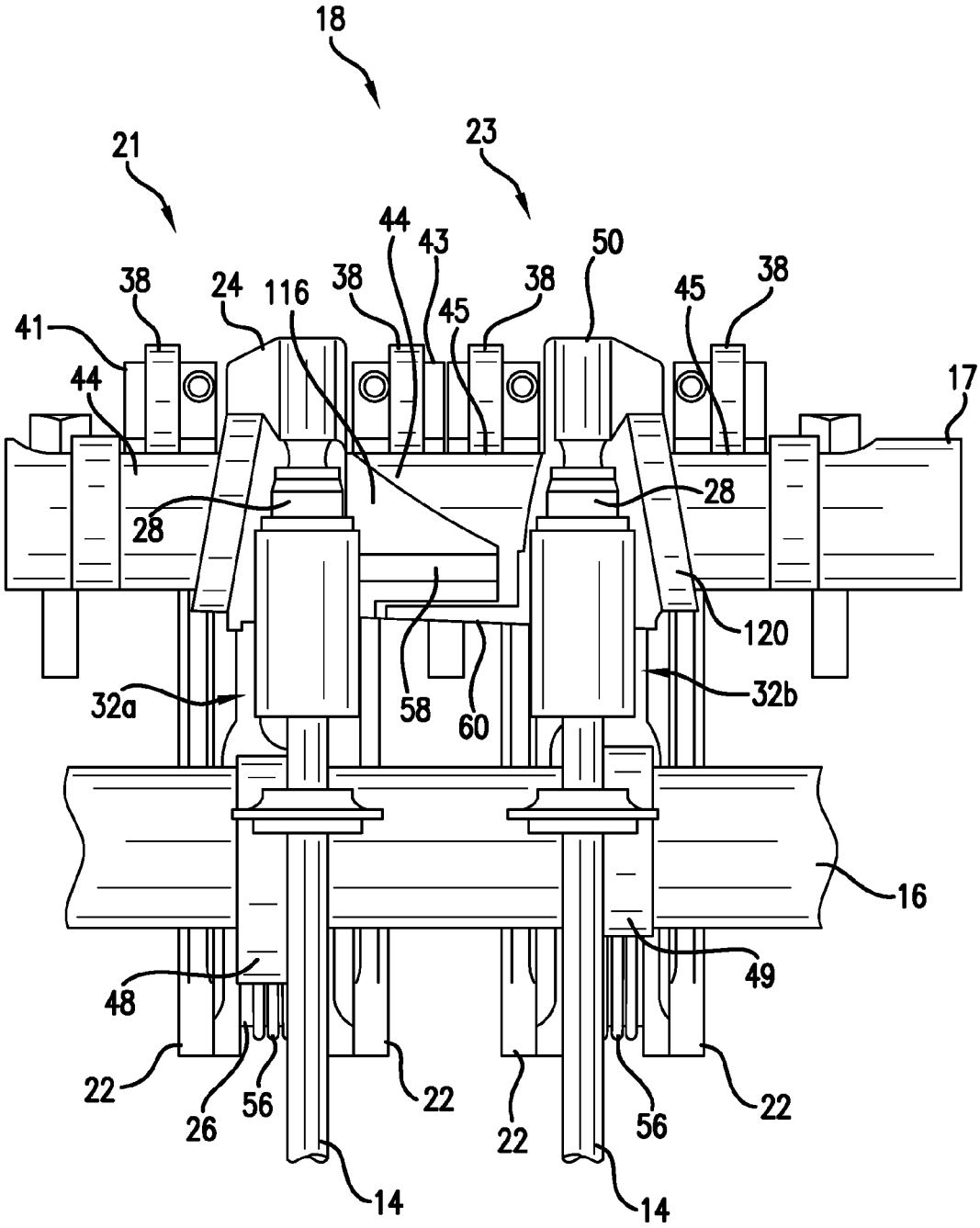
FIG. 4 is an elevation view of a portion of the internal combustion engine of FIG. 1.
Figure 5:
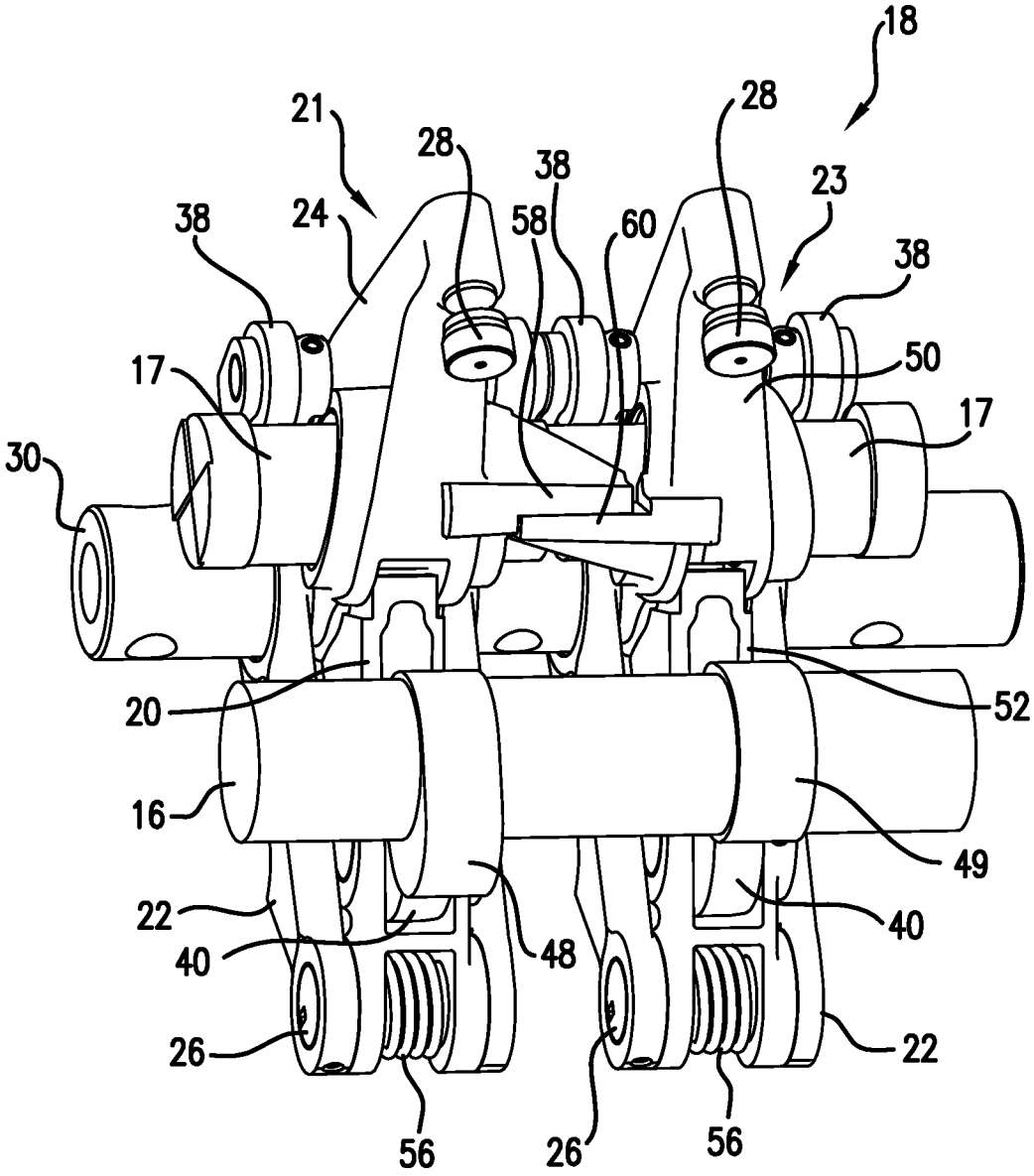
FIG. 5 is a third perspective view of a portion of the internal combustion engine of FIG. 1.
Figure 6:
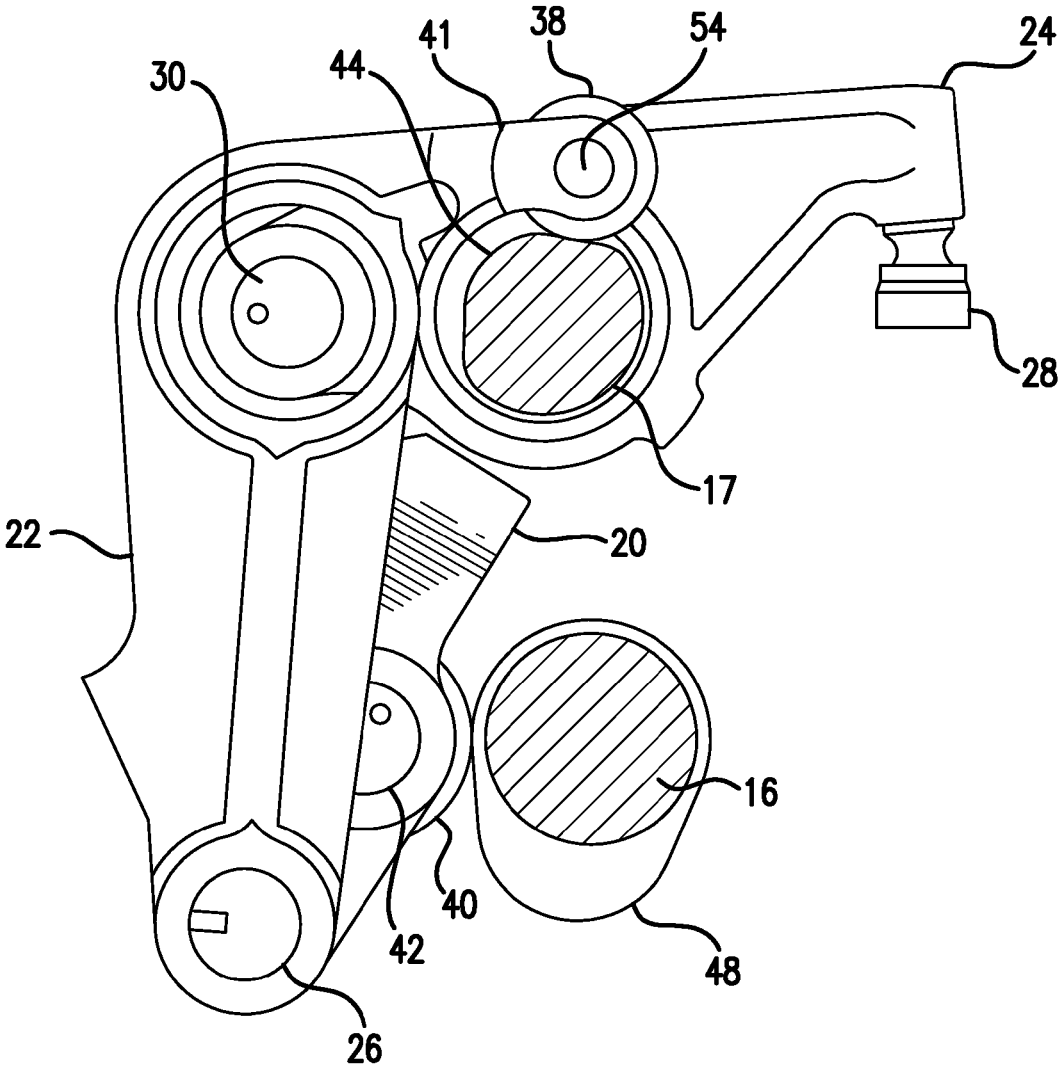
FIG. 6 is an elevation view of certain elements of the internal combustion engine of FIG. 1 in a first position, with a section through the camshaft and the control shaft.

Referring to FIGS. 4 and 5, second portion 23 of valve actuation system 18 includes a second rocker arm 50, a second intermediate lever or arm 52, and another control lever 22. As with first portion 21 of valve actuation system 18, second portion 23 includes another pin 26, pin 30 and pin 42, disposed in the manner described hereinabove. Indeed, all the elements in this portion of valve actuation system 18 are similar to previously described elements, which exceptions noted as follows. Second rocker arm 50 is similar to first rocker arm 24. However, first rocker arm 24 includes a first appendage 58 and second rocker arm 50 includes a second appendage 60. When valve actuation system 18 is in the position shown in FIGS. 4 and 5, first appendage 58 and second appendage 60 are proximate each other, particularly as shown in FIG. 5. The function of first appendage 58 and second appendage 60 will be discussed in more detail hereinbelow.

Roller 40 of second portion 23 located on second intermediate lever 52 engages a cam profile 49 formed on camshaft 16, which may be seen in FIG. 4. Rollers 38 located on control lever 22 of second portion 23 engage cam profiles 45 formed on control shaft 17.

Each tappet assembly 32 includes a hydraulic lash adjuster 62 and a deactivation element 64 that may be positioned within a housing 66. Each tappet assembly 32 is positioned between a respective e-foot 28 and a stem 14*a* of each intake valve 14. A solenoid 68 selectively controls the flow of hydraulic fluid from a common oil circuit (not shown) to each deactivation element 64. A single solenoid 68 may control the flow of hydraulic fluid to each deactivation element 64 individually as a means to deactivate element 64 and as a result absorb the valve motion within the element. Multiple solenoids 68 (not shown) on a separate hydraulic oil circuits could be used to deactivate any one or a number of deactivation elements 64 per cylinder. Hydraulic lash adjuster 62 maintains contact between tappet assembly 32, e-foot 28 and valve 14 to prevent gaps between these components, which may cause noise or increased wear. Hydraulic lash adjuster 62 is an optional component of the system. A valve system associated with the oil circuit (not shown) may provide hydraulic fluid to the hydraulic lash adjuster 62 at a relatively low pressure during valve deactivation to maintain lash between each rocker arm and a respective valve, thus effectively maintaining lash while deselecting or turning off a valve.

Each intake valve actuation system 27 contains components and elements similar to exhaust valve actuation system 18. Indeed, the components forming intake valve actuation system 27 may be identical to those of exhaust valve actuation system 18. Furthermore, the components of intake valve actuation system 27 may be oriented in a mirrored position with some exceptions. Exhaust control shaft 17 may be oriented in a similar direction as intake control shaft 25 if both rotate in the same direction to provide similar functions. However, the orientation of the cams may be opposite that shown in FIGS. 3, 6 and 7, with the appropriate change in direction of rotation. Because of the function of appendage 58 and appendage 60, the positions of first rocker arm 24 and second rocker arm 50 may be reversed in intake valve actuation system 27.

Figure 8:
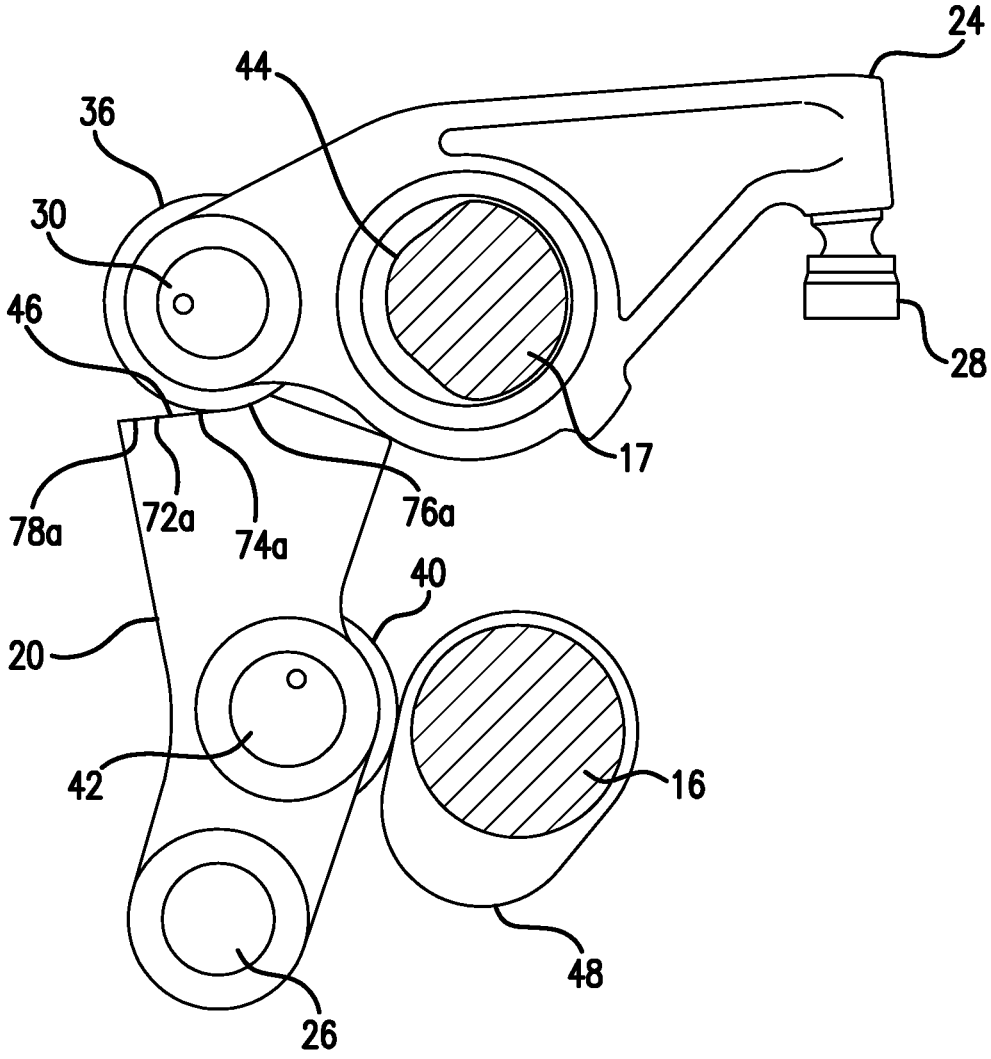
FIG. 8 is an elevation view of the elements of FIG. 7 with control arms removed.

This system operates as follows. As camshaft 16 rotates, cam profile 48 engages roller 40 of first portion 21, forcing intermediate lever 20 to rotate or pivot in a counterclockwise direction about pin 26, which thus forms a pivot point for intermediate lever 20. Since camshaft 16 rotates continuously, the engagement of cam profile 48 with roller 40 causes intermediate lever 20 to oscillate about pin 26. As intermediate lever 20 moves, roller 36 on first rocker arm 24 moves along cam profile 46 of intermediate lever 20. Cam profile 46 forces roller 36 upward, or away from pin 42, as shown in FIG. 8, forcing first rocker arm 24 to move clockwise about exhaust control shaft 17. The movement of first rocker arm 24 is transmitted through e-foot 28 into a tappet assembly 32. If solenoid 68 has provided sufficient pressure to hydraulic lash adjuster 62, then the movement of first rocker arm 24 will cause an associated exhaust valve 14 to move, thus opening the valve into an associated engine cylinder (not shown).

Figure 7:
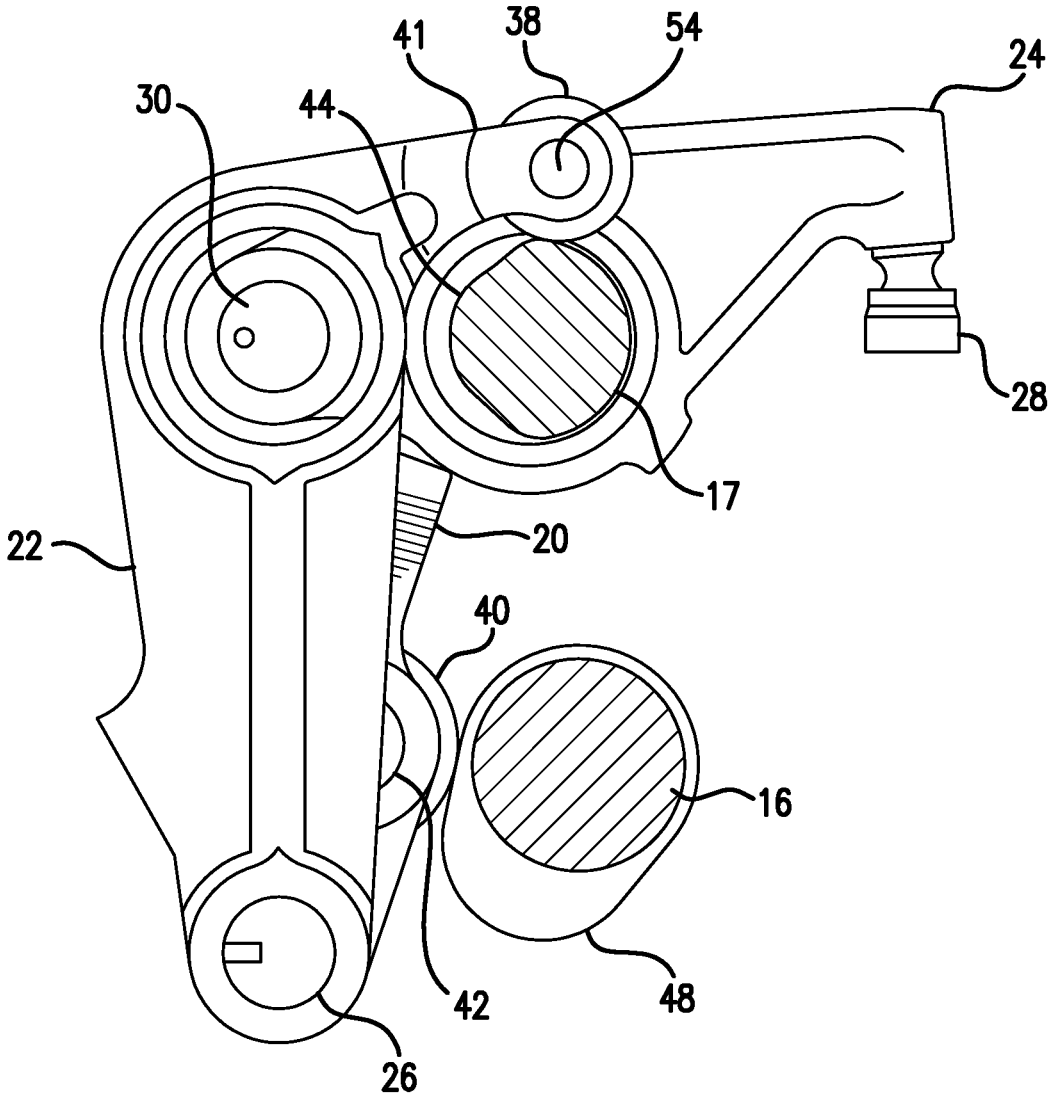
FIG. 7 is an elevation view of the elements of FIG. 6 in a second first position.
Figure 9:
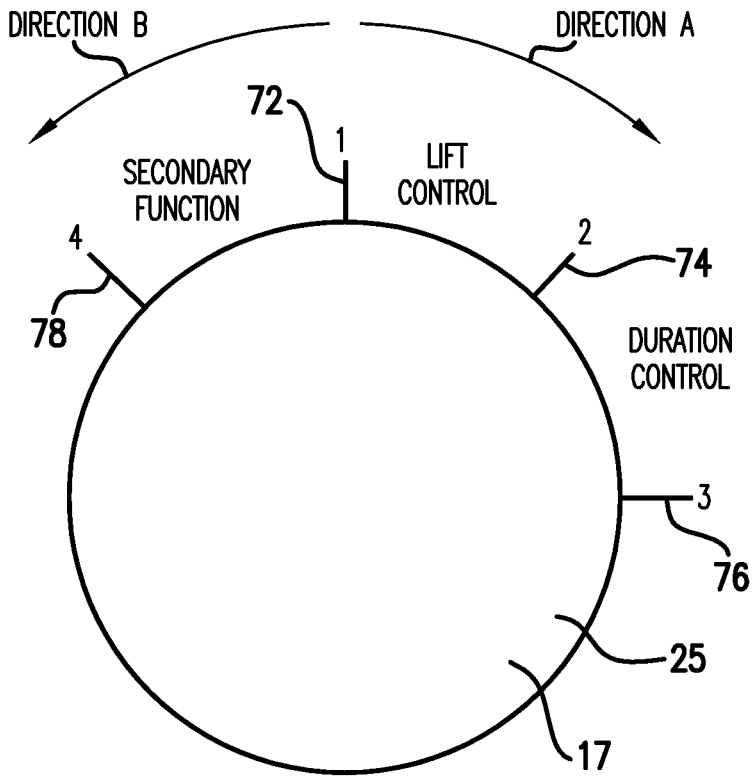
FIG. 9 is a schematic showing the functions of the control shaft of FIGS. 6-8.

Note that the following discussion may be applicable to both exhaust control shaft 17 and intake control shaft 25, and thus FIG. 9 includes the reference numbers for both shafts. Referring to FIG. 9, by rotating control shaft 17 in a direction A from a first position 72 to a second position 74, the pivot point of intermediate arm 20 about pin 42 is moved, which causes cam profile 46 formed on the end of control level 22 to move. As cam profile 46 moves by the action of exhaust control shaft 17, cam profile 46 moves relative to roller 36. Cam profile 46 forces roller 36 to move either upwardly, or away from pin 42, as can be seen in FIGS. 7 and 8, which thus causes first rocker arm 24 to rotate in a clockwise manner. If the motion is upward or clockwise, and if an associated hydraulic lash adjuster mechanism 62 has sufficient pressure applied, then the force from first rocker arm 24 will engage an associated exhaust valve 14 in a different manner than from the action of cam profile 48 alone. Thus, the movement or first rocker arm 24 is moderated by the action of exhaust control shaft 17 and first intermediate arm or lever 20. For example, the profile of cam 44 on exhaust control shaft 17 is such that movement from the position shown in FIG. 6, which is a first position, to the position shown in FIG. 7 adjusts the amount of lift. The first position corresponds approximately to location 72*a* on cam profile 46. Continuing to rotate exhaust control shaft 17 past the second position, which corresponds to location 74*a* on cam profile 46, toward a third position 76 increases the duration of a valve lift event. Third position 76 corresponds to location 76*a* on cam profile 46. Simultaneously with the adjustment of exhaust control shaft 17, exhaust phaser 19*a* may be moving exhaust camshaft 16 to achieve the functions described hereinbelow.

Rotating control shaft 17 from first position 72 to a fourth position 78 causes roller 38 to engage cam profile 44 in an area that causes roller 36 to move to location 78*a* on cam profile 46. Similarly, roller 38 on control lever 22 of second portion 23 engages cam profile 45 in a location that causes roller 36 in second portion 23 to a location 78*a* on cam profile 45. Cam 45 on exhaust control shaft 17 performs a secondary function that is operable only when exhaust control shaft 17 is rotated in a counterclockwise direction. When cam 45 actuates second rocker arm 50, it does so independently from cam 44.

Note that the foregoing description applies equally to exhaust control shaft 25, which controls a first portion 100 and a second portion 102 that are similar to first portion 21 and second portion 23.

It should also be apparent from the foregoing discussion that rotation of first rocker arm 24 in a clockwise direction causes first appendage 58 to engage and move second appendage 60, causing second rocker arm 50 to also move in a clockwise direction. Thus, engagement of exhaust valve first rocker arm 24 causes engagement of exhaust valve second rocker arm 50. However, clockwise rotation of exhaust valve second rocker arm 50 by exhaust camshaft 16 causes appendage 60 to move away from appendage 58, so clockwise rotation of exhaust valve second rocker arm 50 by camshaft 16 or by movement of control shaft 17 does not cause first rocker arm 24 to move. However, counterclockwise motion of second rocker arm 50 by exhaust control shaft 17 will cause appendage 60 to engage appendage 58, causing counterclockwise rotation of first rocker arm 24.

As previously noted, exhaust camshaft 16 and intake camshaft 29 may be controlled by conventional exhaust phaser 19*a* and conventional intake phaser 19*b*. Each phaser has the capability to change the phase angle of a respective camshaft relative to the drive gear of the camshaft. The amount of phase angle change is typically between zero degrees and forty-five degrees. The phase angle may be adjusted independently for both exhaust camshaft 16 and intake camshaft 29 through the respective camshaft phaser by a hydraulic valve arrangement in combination with a camshaft sensor in a conventional manner.

Exhaust camshaft 16, exhaust control shaft 17, intake camshaft 29, intake control shaft 25 and deactivation elements 64 cooperate to provide the functionality for this system, which can be seen from some of the functions achievable in this system, as shown in FIGS. 10 and 11.

In the discussion of the functions that follow, dashed lines are representative of functions obtainable by the above-described mechanism. For example, the early exhaust valve close (EEVC) function can provide an exhaust function from virtually zero to the maximum permissible by the opening of exhaust valves 14. In the case where dashed lines are shifted from solid lines, the dashed lines represent a limit of movement rather than a discrete position. For example, in the variable overlap function the intake function may be at any location between the solid line and the dashed line, including both the solid line and the dashed line. In each discussion, the exhaust function is "a" and the intake function is "b."

The variable overlap function is a modification of when exhaust valves 14 open, shown by curve 80*a* with respect to when intake valves 15 open, shown by curve 80*b*. The amount of overlap is controlled by the timing of exhaust camshaft 16 and intake camshaft 29. The amount of overlap is adjusted by controlling the timing of the exhaust camshaft phaser 19*a* with respect to intake camshaft phaser 19*b*.

To perform an early exhaust valve open (EEVO) function, shown by curve 82*a*, the timing of exhaust valve camshaft 16 is modified with respect to the crankshaft drive (not shown) in combination with rotating exhaust control shaft 17 to a location between second position 74 and third position 76. The rotation of exhaust control shaft 17 causes cam profile 44 to rotate first rocker arm 24 in a clockwise direction, which, because of appendage 58 and appendage 60, also causes second rocker arm 50 to rotate in a clockwise direction. The combination of these two actions causes exhaust valves 14 to open earlier than the opening caused by cam profile 48 of exhaust camshaft 16. Exhaust valves 14 then remain open through the action of cam profile 48, thus causing an extended exhaust valve operation.

A late intake valve close (LIVC) function, also called the Miller Cycle and shown by curve 84*b*, may be accomplished by adjusting intake valve camshaft 29 with respect to the crankshaft drive (not shown) in combination with adjusting intake control shaft 25 to a location between second position 74 and third position 76. As with the EEVO function, cam profile 48 on intake camshaft 29 causes intake valves 15 to open. Then cam profile 44 on intake control shaft 25 causes intake valves 15 to remain open longer than cam profile 48 permits, generating a later closing of intake valves 15.

Internal exhaust gas recirculation (I-EGR), shown by curve 86*b*, may be accomplished by rotating intake control shaft 25 from first position 72 to fourth position 78. The height of cam profile 45 on intake control shaft 25, which may be the same as cam profile 45 on exhaust control shaft 17, causes intake valve 15 to open earlier than the opening caused by a cam profile similar to cam profile 49 formed or positioned on intake camshaft 29. Since second rocker arm 50 is moved, causing appendage 60 to move away from appendage 58, only second rocker arm 50 of second portion 102 is moved. The fourth position of cam profile 44 of intake control shaft 25 is configured to permit cam profile 48 to affect the operation of first rocker arm 24. In the case of this function, first rocker arm 24 is unaffected by cam profile 48, thus intake valve 15 associated with rocker arm 24 is unopened.

Because all force to exhaust valves 14 and intake valves 15 is transmitted from rocker arms through tappet assemblies 32, these valves may be completely deactivated by reducing the pressure in tappet assemblies 32 below a level that would cause pressure to be transmitted to exhaust valves 14 and intake valves 15. This function may be described as cylinder deactivation, shown by curves 88*a* and 88*b*. Note that each tappet assembly 32 may be activated individually. By deactivating one tappet assembly 32 associated with one intake valve 15, a variable swirl function may be accomplished. Note that the variable swirl graph in FIG. 10, shown by curve 90*b*, shows the opening of two exhaust valves 14 and one intake valve 15, with one intake valve 15 deactivated.

By rotating exhaust control shaft 17 from first position 72 toward second position 74, an early exhaust valve close (EEVC) function may be accomplished, shown by curve 92*b*. The shape of cam profile 44 in the region between first position 72 and second position 74 causes a decreased amount of rotation of first rocker arm 24, which decreases the amount of lift of an associated intake valve 14. Since the clockwise rotation of first control arm 24 controls the clockwise rotation of second control arm 50, a decrease in the amount of clockwise rotation of first rocker arm 24 decreases the amount of clockwise rotation of second rocker arm 50. Thus, by rotating intake control shaft 25 from first position 72 toward second position 74, an early intake valve close (EIVC) function may be accomplished, shown by curve 94*b*.

Compression braking may be accomplished by rotating exhaust control shaft 17 from first position 72 to fourth position 78. As previously noted, counterclockwise rotation of exhaust control shaft 17 causes movement of second rocker arm 50 since appendage 60 moves away from appendage 58. Second rocker arm 50 is rotated in a clockwise direction approximately 50 crank angle degrees before EEVO or variable overlap, opening an exhaust valve 14. By opening an exhaust valve 14 in this manner, air compressed during the power stroke is vented to the exhaust rather than adding fuel during the power stroke, thus turning the engine into an air compressor, consuming power rather than adding power.

The valve opening functions shown in FIG. 11 are similar to those in FIG. 10, but there are variations. I-EGR may be accomplished by a pre-lift on an intake valve, which involves pushing a small amount of exhaust into an intake valve 15 during an exhaust stroke to ingest that back into a the cylinder during an intake stroke, or a post-lift, which involves opening an exhaust valve 14 during an intake stroke to ingest exhaust gas from the exhaust manifold (not shown) into a cylinder (not shown). Because of the physical limitations on cam profiles 44 and 45, it may not be possible to accomplish both in a single set of cam profiles. Thus, a first hardware configuration, shown in FIG. 11, may be able to accomplish pre-lift of an intake valve 15, but would not be able to then accomplish a post-lift of an exhaust valve 14, which requires slightly different cam profiles 44 and 45. The difference in hardware is minor, but enables all the same functions shown in FIG. 10. To achieve I-EGR, shown by curve 104*a*, exhaust control shaft 16 is moved from first position 72 to fourth position 78. The height of cam profile 45 on exhaust control shaft 17 causes exhaust valve 15 to open earlier than a cam profile 98 on exhaust camshaft 16 would normally cause. As previously described, only first rocker arm 50 is moved since appendage 60 moves away from appendage 58.

Figure 12:
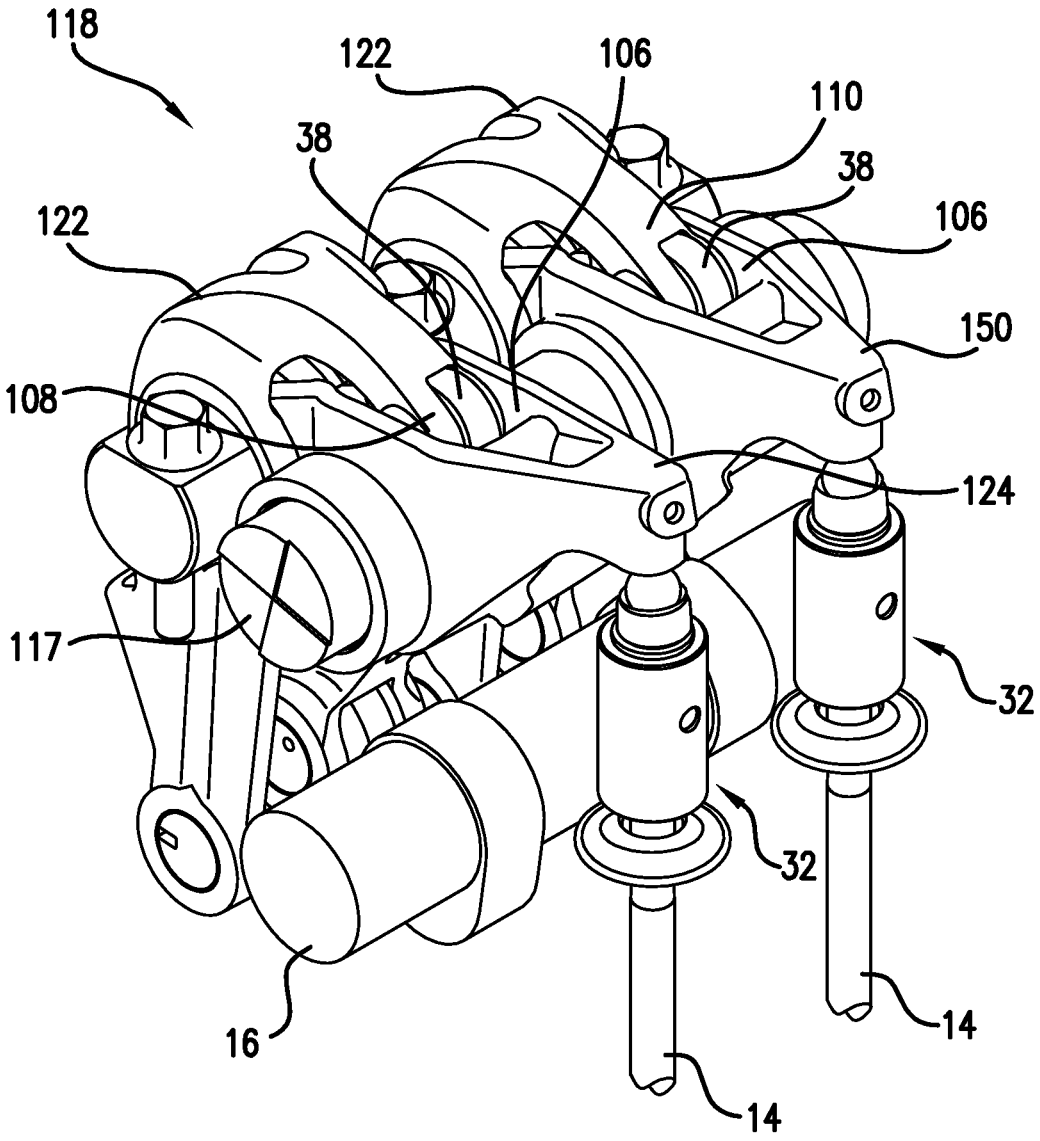
FIG. 12 is a perspective view of a second exemplary embodiment of the present disclosure.
Figure 13:
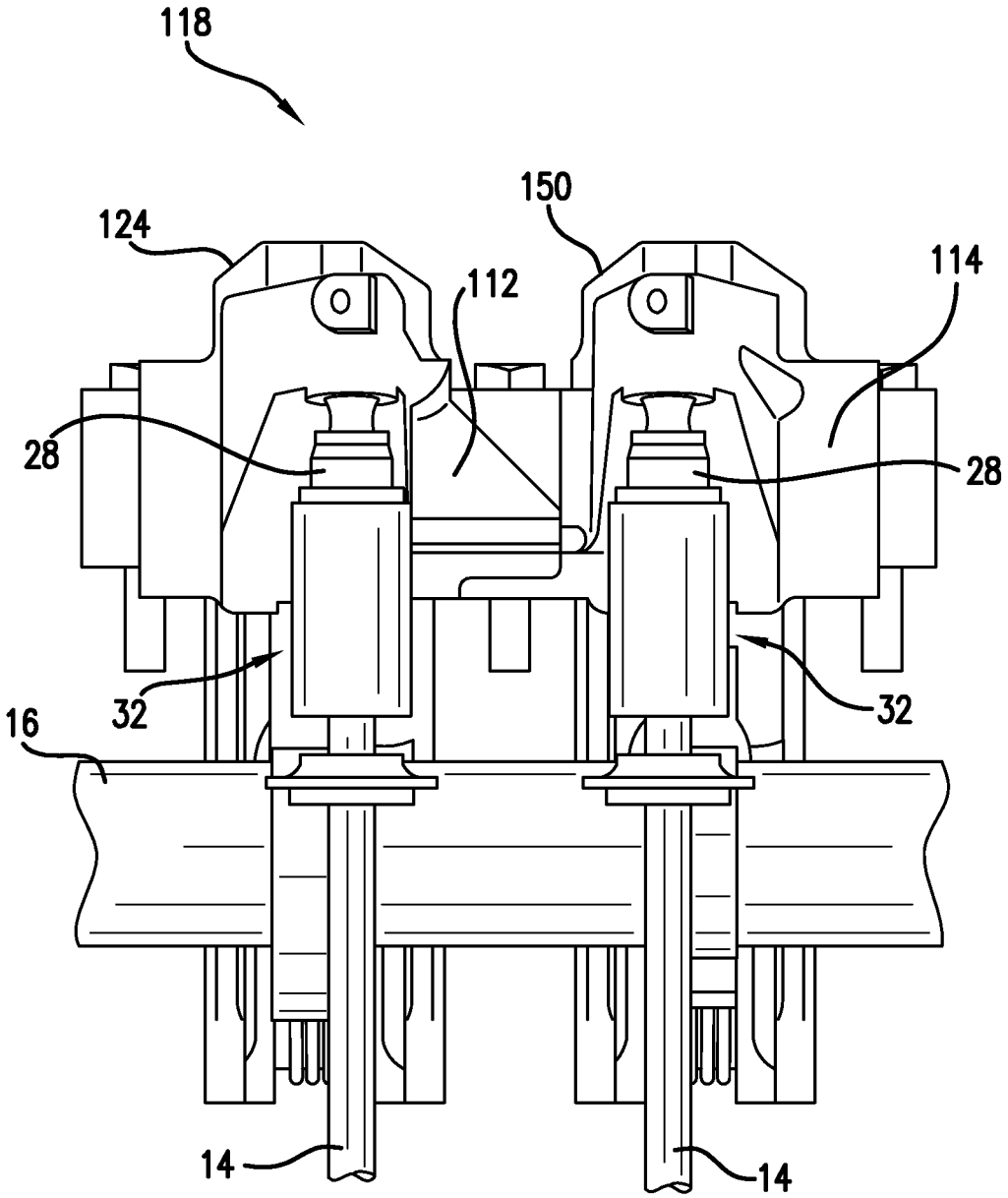
FIG. 13 is an elevation view of the components of FIG. 11.

FIGS. 12 and 13 show a second exemplary valve actuation system 118 of the present disclosure. The elements of this embodiment may be similar to the elements of the previous embodiment, except that a rocker arm 124 and a rocker 150 each have a central opening 106. Opening 106 permits an arm portion 108 and an arm portion 110 or a control lever 122, which performs the same function as control lever 22 of the previous embodiment, to reach an exhaust control shaft 117. This configuration presents several advantages. First, only a single roller 38 of each control lever contacts exhaust control shaft 117, which decreases the need to control the tolerances of control lever 22 for the two rollers 38 required in the previous embodiment. Second, the bearing area 112 of rocker arm 124 and the bearing area 114 of rocker arm 150 against exhaust control shaft 117 may be greatly increased as compared to bearing area 116 of first rocker arm 24 and bearing area 120 of second rocker arm 50.

While various embodiments of the disclosure have been shown and described, it is understood that these embodiments are not limited thereto. The embodiments may be changed, modified and further applied by those skilled in the art. Therefore, these embodiments are not limited to the detail shown and described previously, but also include all such changes and modifications.

I claim:

1. An internal combustion engine, comprising:

a camshaft including a first cam;

a control shaft including a second cam;

a valve; and a valve actuation system adapted to be driven by the first cam and the second cam, the valve actuation system including: an intermediate arm adapted to oscillate by the action of the first cam about a first pin, the intermediate arm including a third cam formed on an end thereof and a first roller located on a second pin; a first rocker arm rotatably positioned on the control shaft and including a foot at a first end that causes movement of the valve by the action of the first cam, and a second roller at a second end opposite the first end, wherein the second roller is adapted to rotate about a third pin and the second roller is adapted to engage the third cam; and a control arm adapted to rotate about the first pin and including a third roller in contact with the second cam such that a profile of the second cam causes the control arm to pivot about the third pin, forcing the intermediate arm to move, moving the third cam with respect to the second roller, thereby causing the first rocker arm to rotate about the control shaft and to change the amount the valve moves.

2. The internal combustion engine of claim 1, further including a tappet assembly positioned between the foot and the valve, the tappet assembly including a deactivation element.

3. The internal combustion engine of claim 2, wherein the deactivation element is operable to prevent movement of the first rocker arm from causing movement of the valve.

4. The internal combustion engine of claim 1, wherein rotation of the control shaft in a first direction causes the valve to be open in advance of opening by the first cam.

5. The internal combustion engine of claim 1, wherein the amount the valve opens is less than the amount the valve opens by the action of the first cam.

6. The internal combustion engine of claim 1, wherein rotation of the control shaft in a second direction causes the amount the valve opens by the action of the first cam to be decreased.

7. The internal combustion engine of claim 1, further including a second rocker arm, wherein the first rocker arm and the second rocker have appendages formed thereon, the appendages being adapted to cause rotation of the second rocker arm when the control shaft is rotated in a first direction and to permit the first rocker arm to rotate independently from the second rocker arm when the control shaft is rotated in the second direction.

8. The internal combustion engine of claim 1, wherein the second cam is configured to cause partial actuation of the valve when the control shaft is rotated in a first direction and full actuation when the control shaft is rotated in a second direction.

9. The internal combustion engine of claim 8, wherein rotation of the control shaft in the first direction permits compression braking.

10. The internal combustion engine of claim 8, wherein rotation of the control shaft in the second direction decreases the amount the valve is opened by the rocker arm.

11. The internal combustion engine of claim 1, wherein the valve is an intake valve.

12. The internal combustion engine of claim 1, wherein the valve is an exhaust valve.

13. The internal combustion engine of claim 1, wherein the rocker arm has an opening formed therein that permits the third roller to access the second cam through the opening.

14. The internal combustion engine of claim 1, wherein the camshaft is located in a region longitudinally between the rocker arm and an engine body of the internal combustion engine.

15. An internal combustion engine, comprising:

a camshaft;

a control shaft;

a valve;

a first rocker arm rotatably positioned on the control shaft and adapted to be moved by the camshaft to open the valve; and an intermediate arm positioned between the camshaft and the first rocker arm, the intermediate arm movable by the action of the control shaft to change the amount the first rocker arm opens the valve, the control shaft including a control cam having a cam profile, the internal combustion engine further comprising a control arm operably coupled to the intermediate arm and contacting the control cam such that rotation of the control shaft causes the control arm to pivot, forcing the intermediate arm to move, and causing the first rocker arm to rotate about the control shaft to change the amount the valve moves.

16. The internal combustion engine of claim 15, wherein movement of the control shaft causes the valve to open in advance of opening of the valve by the action of the camshaft.

17. The internal combustion engine of claim 15, wherein movement of the control shaft decreases the amount the valve is opened by the action of the camshaft.

18. The internal combustion engine of claim 15, wherein movement of the control shaft causes the valve to open after opening of the valve by action of the camshaft.

19. An internal combustion engine, comprising:

a camshaft;

a control shaft;

a valve;

a first rocker arm rotatable positioned on the control shaft and adapted to be moved by the camshaft to open the valve;

an intermediate arm positioned between the camshaft and the first rocker arm, the intermediate arm movable by the action of the control shaft to change the amount the first rocker arm opens the valve;

a first appendage formed on the first rocker arm, and a second rocker arm including a second appendage formed on the second rocker arm, wherein rotation of the control shaft in a first direction causes the first appendage to engage the second appendage to rotate the first rocker arm and the second rocker arm, and rotation of the control shaft in a second direction causes the first rocker arm to rotate independent of the second rocker arm.

20. The internal combustion engine of claim 19, wherein rotation of the control shaft in a second direction opposite the first direction causes the second rocker arm to rotate independently of the first rocker arm.

21. The internal combustion engine of claim 19, wherein movement of the control shaft causes the valve to open after opening of the valve by action of the camshaft.

* * * * *